US006295983B1

(12) United States Patent
Semeia

(10) Patent No.: US 6,295,983 B1
(45) Date of Patent: Oct. 2, 2001

(54) FOLDABLE SNORKEL

(75) Inventor: Roberto Semeia, San Salvatore di Cogorno (IT)

(73) Assignee: Scubapro Europe S.r.l. (IT)

( * ) Notice: Subject to any disclaimer, the term of this patent is extended or adjusted under 35 U.S.C. 154(b) by 0 days.

(21) Appl. No.: 09/487,323

(22) Filed: Jan. 19, 2000

(30) Foreign Application Priority Data

Jan. 29, 1999 (IT) ..... GE99A0011

(51) Int. Cl.[7] ..... B63C 11/16

(52) U.S. Cl. ..... 128/201.11; 128/201.26; 128/201.27; 128/201.28; 128/201.29; 128/200.29; 128/206.29; 405/186; 405/187

(58) Field of Search ..... 128/201.11, 201.26, 128/201.27, 201.28, 201.29, 200.29, 206.29; 405/186, 187; 181/127, 21

(56) References Cited

U.S. PATENT DOCUMENTS

| | | | | |
|---|---|---|---|---|
| 4,878,491 | * | 11/1989 | McGllvray, III | 128/201.11 |
| 5,199,422 | * | 4/1993 | Rasocha | 128/201.11 |
| 5,906,199 | * | 5/1999 | Budzinski | 128/201.11 |
| 6,079,410 | * | 6/2000 | Winefordner et al. | 128/201.11 |

FOREIGN PATENT DOCUMENTS

| | | |
|---|---|---|
| 1 515 610 | 6/1968 | (FR) . |
| 2 609 962 | 7/1988 | (FR) . |

* cited by examiner

*Primary Examiner*—John G. Weiss
*Assistant Examiner*—Mital Patel
(74) *Attorney, Agent, or Firm*—Larson & Taylor, PLC

(57) ABSTRACT

Aeration tube provided on its lower end with a mouthpiece (2) and on its upper end with an air intake hole (41), such tube consisting in its length of two or more tubular elements (1, 3) connected in such a way that the tube can be folded two or more times on itself.

20 Claims, 4 Drawing Sheets

FOLDABLE SNORKEL

TECHNICAL FIELD OF THE INVENTION

The present invention relates to snorkel used by scuba divers at the beginning and at the end of a diving session with air tanks, that is to say, when getting into and out of the water.

BACKGROUND OF THE INVENTION

Snorkels of the known type consist of a cylindrical element which is normally bent on its lying plane, mainly made of a mouthpiece on its lower end and an air intake hole on its upper end; moreover, they are connected, by means of hooks or the like, to the strap of the diving mask. A tube of this kind has a certain length in its lying and folding plane so that, at the end of its use, for instance at the stage when the scuba diver gets into the water, it is encumbering and difficult to place, whether the scuba diver decides to leave it attached to the mask strap or wants to put it for instance into a pocket of his jacket or of his wet suit.

As is known there are the so-called telescopic systems, consisting of coaxial tubes allowing to shortening of the snorkel so as to make it smaller once the scuba diver has gone into the water. However, with such systems at least a portion of the snorkel has to be straight, so as to have an area where said coaxial tubes of the snorkel move and the stroke made by such systems is limited only to the straight portion; moreover, coaxial tubes necessarily create either an inner section which is too small or an outer diameter which is aesthetically abnormal, since the inner section should have a diameter which is physiologically acceptable as far as breathing is concerned.

SUMMARY OF THE INVENTION

The present invention aims at achieving a snorkel which overcomes the disadvantages of the known systems mentioned above and giving the possibility to be practically reduced to half its length rapidly, and be put, once the scuba diver has gone into the water, into a pocket of his jacket or of his wet suit or into suitable loops by the scuba diver and which can be moreover easy to find and to refit when the diver begins to get out of the water.

Such purpose is achieved in the present invention by means of an snorkel provided on its lower end with a mouthpiece and on its upper end with an air intake hole, such snorkel consisting in its length of two or more tubular elements which are connected in such a way that the tube can be folded two or more times on itself.

According to a feature of the present invention such snorkel consists of a lower tubular element including on its lower end said mouthpiece and of an upper tubular element including on its upper end said air intake hole, the upper end of the lower tubular element and the lower end of the upper tubular element being reciprocally connected, in a configuration of use as a single tube, through retaining means, said means allowing the rotation of one of said tubular elements so as to fold onto to the other in a substantially perpendicular direction to the lying plane of the tube, thus obtaining a configuration of non-use or with tubular elements one beside the other, in which the lower and upper ends of the lower tubular element are respectively beside the upper and lower ends of the upper tubular element.

According to preferred embodiments of the present invention the retaining means are comprise hinges which ensure both the sealing and the locking of the two elements in each configuration, both of use as a single tube and of non-use with tubular elements one beside the other, in the latter the length of the snorkel being practically half its normal use size, thus making the snorkel easy to store.

BRIEF DESCRIPTION OF THE DRAWINGS

The present invention will be better understood by reference to the following embodiments, which are considered as an example, non-limiting, and referring to the enclosed drawings, where.

DETAILED DESCRIPTION OF THE PREFERRED EMBODIMENTS OF THE INVENTION

Figure 1:
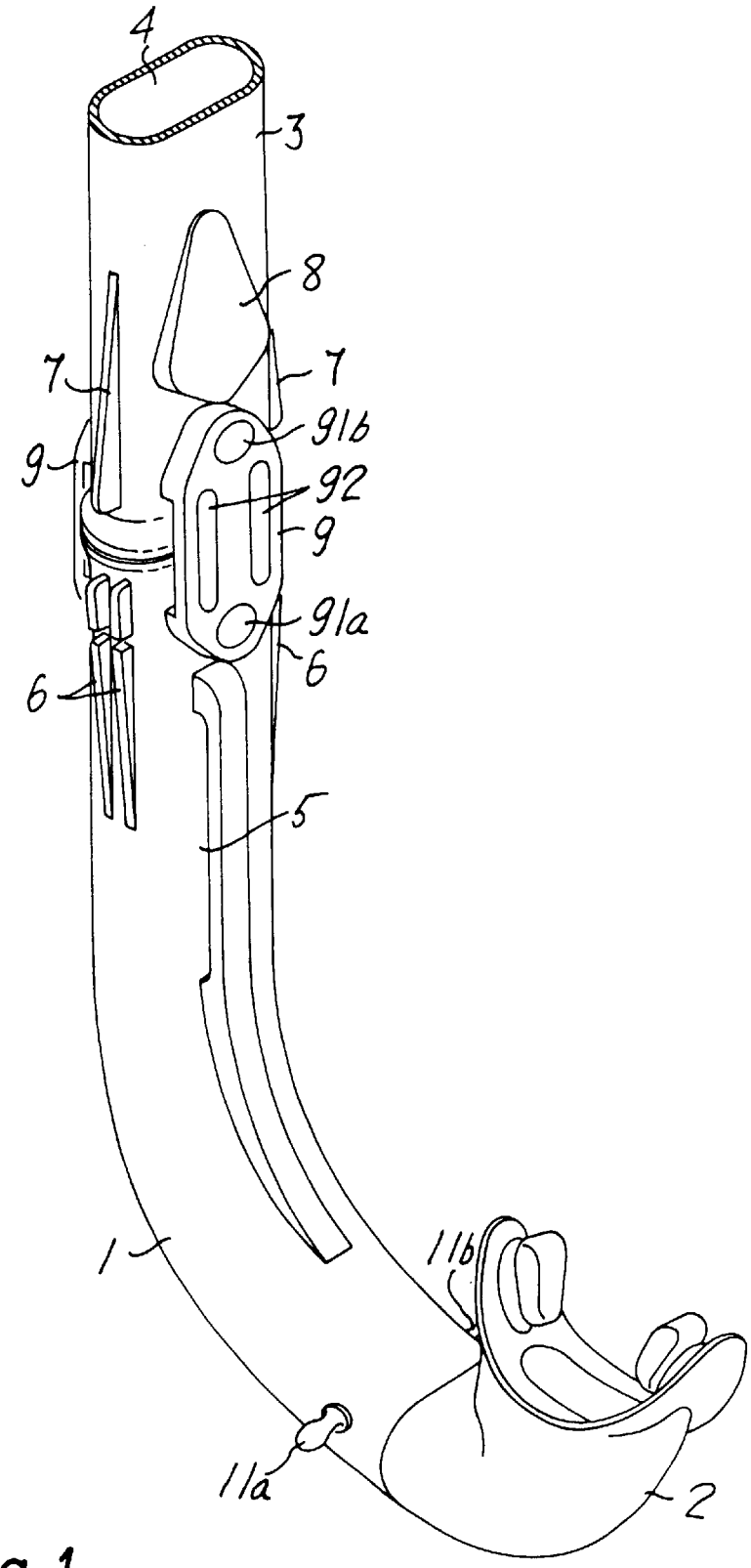
FIG. 1 shows a perspective view of a first embodiment of the snorkel of the present invention in the configuration of use as a single tube.
Figure 3:
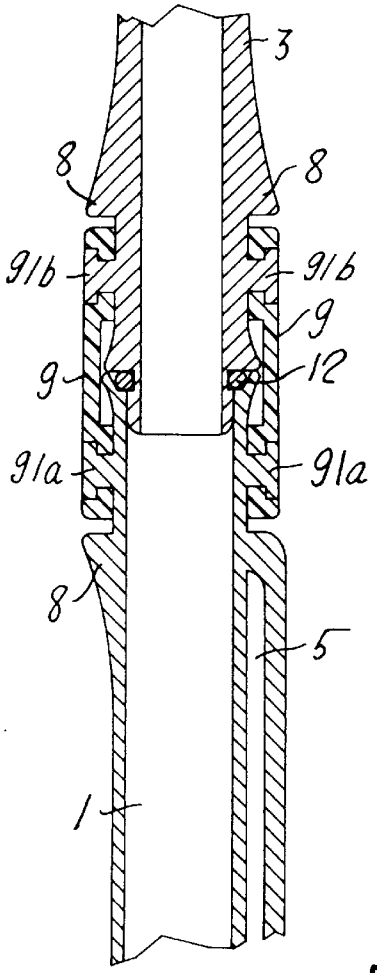
FIG. 3 shows a partial view of the two tubular elements in the configuration of use.

With reference to FIG. 1, as a single tube mainly consists of a lower tubular element 1 onto whose lower end a mouthpiece 2 is fixed, and of an upper tubular element 3, here only partially shown for reasons of clearness, which is characterised by a physiologically suitable inner section 4 for the passage of air. As can be observed, there is shown herein the configuration use or as a single tube element 1 a loop 5 has been provided, such loop to be used in case a hook for the mask strap is present, together with two ribs 6 on each lateral coupling surface (as will be seen later) forming between themselves a guide whose purpose, as will be seen later, is to be connected to the correspondent rib 7, which is also provided on both lateral surfaces of element 3. Moreover, such aeration tube has three profiles 8 which are useful to protect two elastic hinges 9 from the risk of abrasions, said profiles 8 being provided on the front and rear surface (not visible) of the element 3 and on the rear surface (non visible) of the element 1. The elastic hinges 9 are useful trip-type means to maintain the snorkel in its original position and they are each fixed in a longitudinal direction with respect to the two elements 1 and 3 by means of suitable fixed pins 91*a* and 91*b*. Both fixed pins 91*a* and 91*b* allow the hinges to rotate around them. Moreover, said hinges include loops 92 in case a hook for the mask strap is used. Moreover, on the element 1 there are two side connection pins, denoted 11*a* and 11*b* which, as will be later seen, will be used in the configuration with the elements 1 and 3 one beside the other or configuration of non-use to ensure their reciprocal coupling. Side connection pin 11*b* is only partially shown because of the angle of the view. The sealing of the snorkel with the elastic hinges 9 is ensured by the partial introduction of the element 3 into the element 1 in correspondence with said hinges and by a sealing ring 12. In the configuration of use, as shown in FIGS. 1 and 3 thus the scuba diver is either getting into or out of the water before or after a diving session with air tanks.

When the scuba diver has just gone down into the water, that is to say, the stage after the snorkel has been is used, the latter should be made as small as possible, whether it is put into a pocket, in the wet suit for example, or in the diver's jacket.

The snorkel described above can be practically reduced to half its length simply by taking the element 3 and by rotating it with respect to the element 1, and this is possible because of the two hinges 9 which undergo an elastic deformation rotating around the two fixed pins 91*a*, so as to allow said rotation of the element 3, which, as can be deduced from FIG. 1, can be symmetrically achieved in a perpendicular direction with respect to the lying plane of the snorkel tube towards one or the other of the lateral surface of the element 1.

Figure 2:
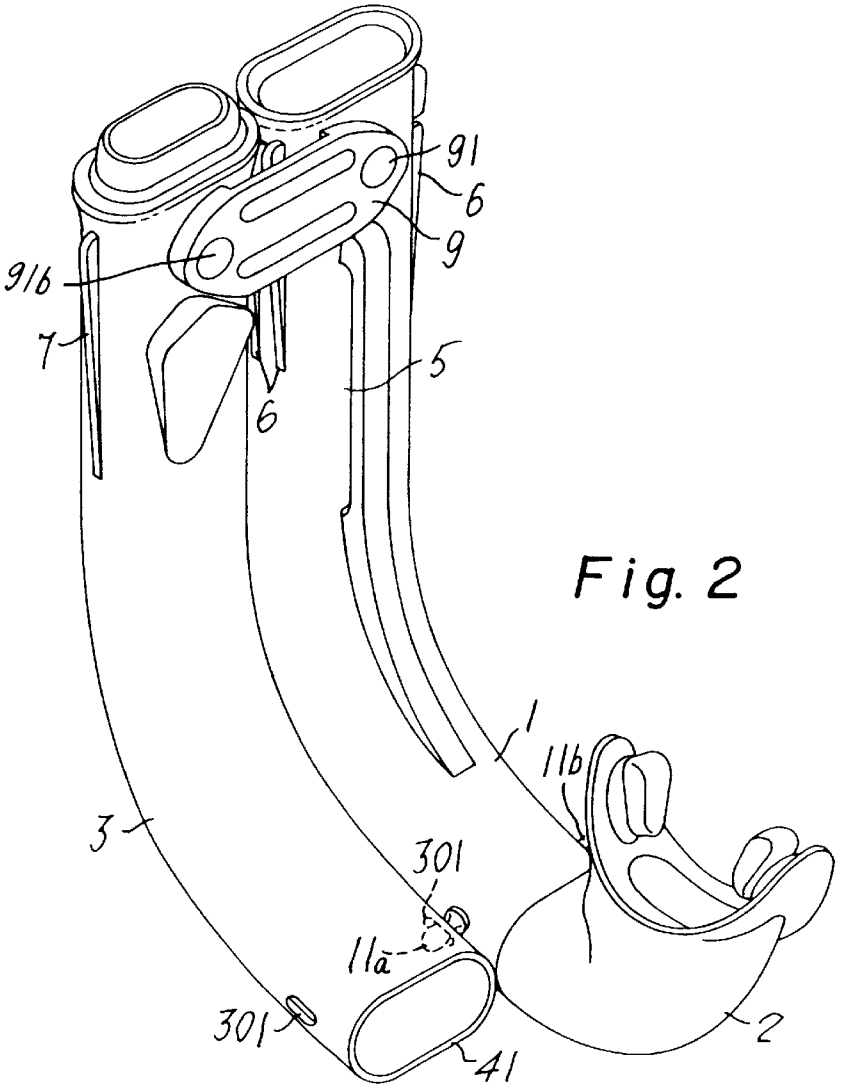
FIG. 2 shows a perspective view of FIG. 1 in the configuration of non-use with tubular elements one beside the other.

At the end of such rotation of the hinges 9, which have undergone an elastic springback, the element 3 has been released so as to be beside the element 1 according to the configuration shown in FIG. 2, that is to say, the configuration of non-use of the tube, said hinges 9 now being placed perpendicularly to the two elements 1 and 3. At this point, element 3 has been rotated substantially 180° in relation to element 1. Element 3 can be rotated in the opposite direction, resulting in a full field of rotation of substantially 360°. The passage from the configuration of non-use to the configuration of use and the opposite, in case the scuba diver gets back to the surface at the end of the diving session and uses the snorkel once more to get out of the water, is similarly achieved by taking one of the two tubular elements, either 1 or 3, and by rotating it with respect to the other, either 3 or 1, going back to the configuration of FIG. 1. As can be observed in FIG. 2 the two ends of the elements 1 and 3 being respectively provided with the mouthpiece 2 and the air intake hole 41, are placed one beside the other and are coupled together by introducing one of the two side connection pins 11*a*, 11*b* into the corresponding hole 301 according to the rotation direction of the element 3 chosen by the scuba diver when folding the snorkel. Moreover, such configuration can be maintained by introducing one of the two ribs 7, on the element 3, into the related guide formed by the corresponding rib 6 in the element 1. FIG. 1 shows the positioning of the two elements 1 and 3 in the configuration of use as a single tube, the element 3 being partially introduced into the element 1 and the sealing being ensured by the presence of the elastic hinges 9 and by the sealing ring 12. As previously mentioned, the hinges 9 are protected against the risk of abrasion while diving by the three profiles 8 and by the profile forming the loop 5 for the possible introduction of a hook for the mask strap.

Figure 4:
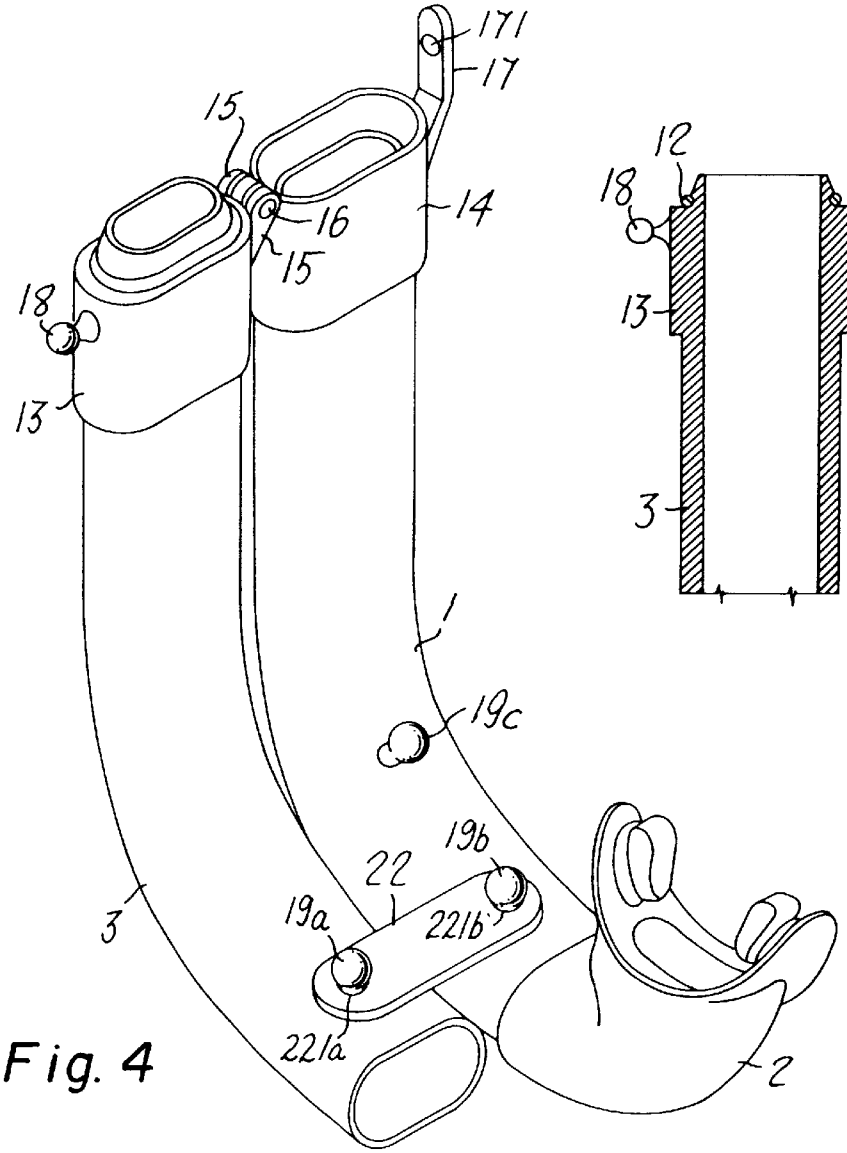
FIG. 4 shows a perspective view of an another embodiment of the snorkel in the configuration of non-use with tubular elements one beside the other.

FIG. 4 shows an embodiment of the snorkel of the present invention in the configuration with the elements one beside the other. In such configuration the trip-type retaining means of the two elements in the configuration of use and non-use consist of a hinge system including an upper bushing 13 fixed onto the element 3 a lower bushing 14 fixed onto the element 1, hinges connected to each of the bushings 13 and 14 and a hinge pin 16 connecting together the two hinges 15. Such lower bushing 14 is also connected to a flexible tab 17 provided with a hole 171, whereas the upper bushing 13 is connected to a corresponding tab in 18. Moreover, the element 1 has coupling tabs 19*b* and 19*c* corresponding to the coupling tab holes 221*a* and 221*b* of a coupling tab 22 in the configuration of use of the snorkel, whereas the element 3 is provided with a coupling tab pin 19*a* corresponding to the coupling tab hole 221*a* of the tab 22 in the configuration of non-use. The hinges 15 and the hinge pin 16 thus allow rotation of one of the two elements 1 and 3 with respect to the other from the configuration of non-use which is shown FIG. 4 to the configuration of use shown in FIG. 6, and vice-versa. The coupling tab hole 221*a* can be linked to the coupling tab pin 19*a* by simply lifting the tab 22 so as to free said hole 21*a* from the coupling tab pin 19*c* and by rotating said tab 22 around the coupling tab pin 19*b*.

Figure 5:
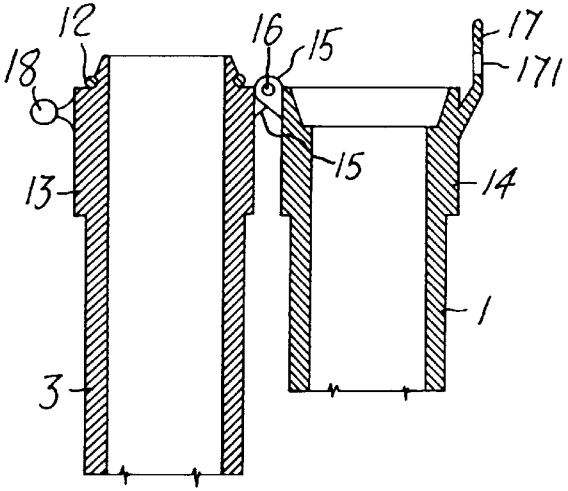
FIG. 5 shows a partial section view of the coupling system in FIG. 4 in the configuration with elements one beside the other.

As an alternative, referring to FIG. 5, the hinges 15, the corresponding hinge pin 16, the tab 17 and the corresponding tab pin 18 can be connected to the elements 1 and 3 as a single piece. In such case, for structural reasons, the sections of the two elements placed near the hinges 15 are suitably greater than their nominal section, as can be clearly seen in the figure. Moreover, a sealing ring 12 is provided near the lower end of the element 3, which end is introduced into the element 1 in the configuration of use.

Figure 6:
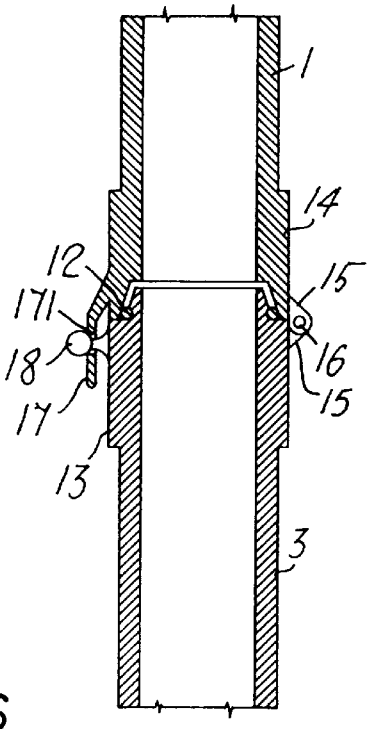
FIG. 6 shows a section view of the coupling system in FIG. 4 in the configuration as a single tube.

Such use configuration is shown in FIG. 6, where due stress is given to how the hole 171 of the tab 17 is connected with a release system with the pin 18 by means of a small elastic deformation of the tab itself, and it is also evident that, in order to return to the configuration of non-use, it is simply necessary to lift the tab 17 and rotate it towards the right one of the two elements 1 and 3.

Figure 9:
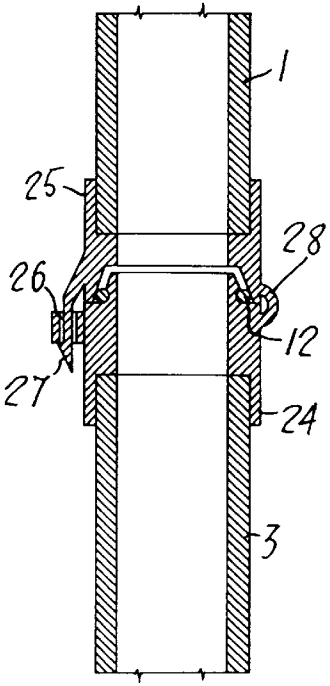
FIG. 9 shows a section view of the coupling system in FIG. 7 in the configuration as a single tube.
Figure 8:
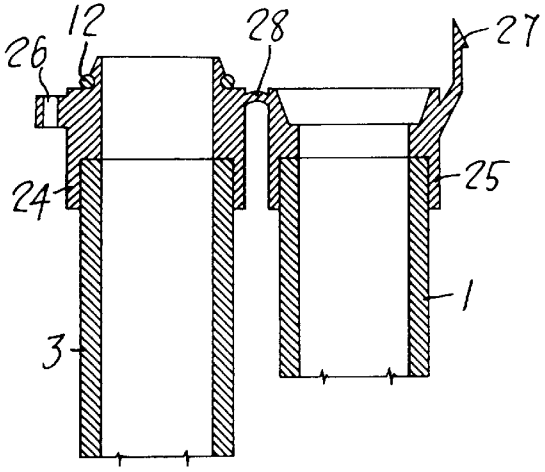
FIG. 8 shows a section view of the coupling system in FIG. 7 in the configuration with elements one beside the other.
Figure 7:
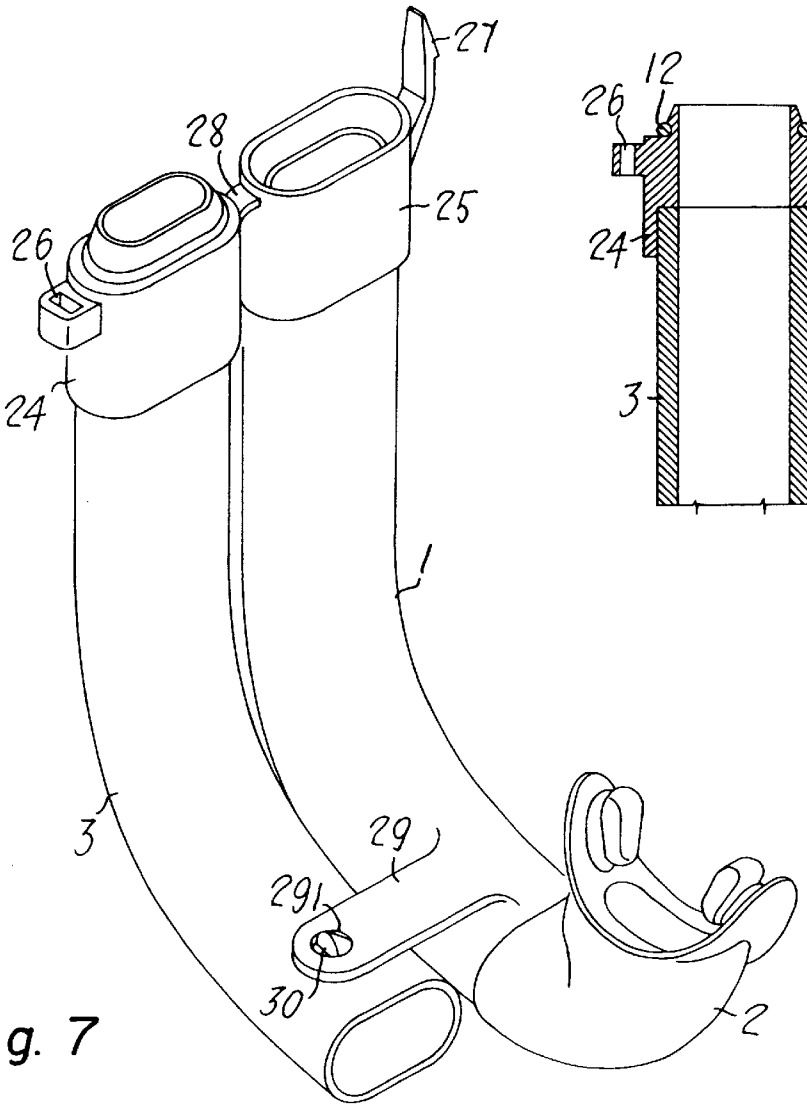
FIG. 7 shows a perspective view of another embodiment version of the snorkel in the non-use configuration with tubular elements one beside the other.

Another embodiment of the present invention is shown in FIGS. 7 through 9 wherein the release retaining means comprises a coupling system including an upper bushing 24 fixed onto the element 3 and a lower bushing 25 fixed onto the element 1. The upper bushing 24 is provided with a bridge hole 26, whereas the lower bushing 25 is provided with a flexible arrow-shape tab 27 corresponding to the said bridge hole 26. The two bushing 24 and 25 are connected by means of a flexible hinge 28 which is preferably made of the same material as the bushings. From the lower portion of the element 1 a flexible tab 29 is formed as one piece, said tab having a hole 291, whereas the element 3 has a corresponding tooth 30 projecting up and formed as one piece herewith. In order to assure that the parts are locked together in the configuration of non-use as shown in FIG. 7, it is simply necessary to introduce the tooth 30 into the hole 291 of the flexible tab 29, by means of an elastic deformation of the tab itself. Obviously, also for this embodiment, instead of the bushings 24 and 25, it is possible to form the hinge 28, the tab 27 and the bridge hole 26 from the tubular elements 1 or 3 as one piece.

FIGS. 8 and 9 show the coupling system of FIG. 7 in the two configurations of non-use and of use of the snorkel. It should be noted that, in order to change from the configuration in FIG. 8 to the one in FIG. 9 it is simply necessary to rotate the element 1 around the hinge 28 so that the arrow-shaped tab 27 can be releasably introduced into the corresponding bridge hole 26, whereas in order to change from the configuration in FIG. 9 to the one in FIG. 8 it is simply necessary to press the tab 27 towards the inside of the snorkel, that is to say, towards the right as shown in FIG. 9, so as to allow the rotation towards the right, for instance of the element 1 around the hinge 28.

As it has been possible to observe from the previous description, the advantages deriving from the use of a folding snorkel according to the embodiments described as an example are manifold, and such are the versions which can be adopted in order to obtain such advantages without going beyond the frame of the enclosed claims.

What is claimed is:

1. A snorkel having a stiff upper tube operatively connected to an air intake opening at the upper end of the snorkel and a stiff lower tube with a mouthpiece at its lower end, said tubes being moveable between a use position and a non-use position, wherein:

in the use position, the upper and lower tubes are aligned with each other to form a single air passage therethrough, the lower tube being curved in a lying plane of the snorkel in the use position, a retaining structure connecting the upper and lower tubes in the use position so as to form a single air passage through both the said tubes, and said retaining structure arranged to release the upper tube from the lower tube while still connected to both of said tubes to allow the upper tube to fold about the top of the lower tube in a direction generally perpendicular the lying plane of the snorkel so as to be positioned beside the lower tube in the non-use position.

2. A snorkel according to claim 1, wherein the snorkel consists of two tubes, wherein in the use position the upper tube has the air intake at the top thereof and the lower tube has the mouthpiece at the lower end thereof, and the retaining structure retains the two tubes together.

3. A snorkel according to claim 1, wherein the upper tube is foldable onto either side of the lower tube, whereby the upper tube is capable of moving to a position of approximately 360° around the lower tube.

4. A snorkel according to claim 1, wherein said retaining structure includes a pair of elastic hinges on diametrically opposite sides of the snorkel, each hinge being connected to the lower end of the upper tube and to the upper end of the lower tube by means of a pair of pins on each of the upper and lower tubes, said pair of elastic hinges being rotatable around any of said pins.

5. A snorkel according to claim 4, wherein one of said tubes is rotatable with respect to the other about an angle of substantially 360°.

6. A snorkel according to claim 4, wherein in the use position, the elastic hinges urge the upper and lower tubes together into an airtight connection, and in the non-use position the elastic hinges urge the two tubes together side-by-side.

7. A snorkel according to claim 5, including coupling means comprising a pair of pins, one diametrically opposite each other at the upper end of the upper tube and a pair of corresponding holes on the lower end of the lower tube positioned such that one of said pins enters one of said holes to retain the two tubes side-by-side in the non-use position.

8. A snorkel according to claim 4, comprising anti-abrasion profiles on at least one of the tubes adjacent said elastic hinges.

9. A snorkel according to claim 4, further comprising guide means disposed on surfaces of one of the tubes which mate with corresponding guide means on the surface of the other tube for retaining the two tubes side-by-side in the non-use position.

10. A snorkel according to claim 4, further comprising at least one loop on one of said tubes for receiving a fixing means such as a strap or the like.

11. A snorkel according to claim 4, wherein said pair of elastic hinges include loops for the introduction of a fixing means such as a strap or the like.

12. A snorkel according to claim 1, said retaining structure comprising a first bushing fixed onto a lower end of the upper tube and a second bushing fixed onto upper end of the lower tube, said bushings having a hinge and including a pin connecting said hinges, and one of said bushings having an elastic tab provided with a hole connectable to a tab pin on the other said bushings.

13. A snorkel according to claim 12, wherein the tab pin, the corresponding tab and the hinge with its corresponding pin are formed as one piece with the tubes.

14. A snorkel according to claim 5, including coupling means comprising an elastic tab provided with a hole on one of the tubes, said elastic tab being rotatable about a pin connected to the surface of one of said tubes and a pin on the surface of the other of said tubes.

15. A snorkel according to claim 7, further comprising a second pin on the surface containing the first said pin for receiving the end of the elastic tab opposite from the first said pin.

16. A snorkel according to claim 1, said retaining structure including a bushing fixed onto a lower end of the upper tube and a bushing fixed onto the upper end of the lower tube, said bushings being connected to each other by a flexible hinge and one of said bushings being connected to an elastic tab, and including a bridge hole on the other bushing to receive said elastic tab.

17. A snorkel according to claim 16, wherein the bridge hole, the corresponding tab and the hinge are all formed as one piece with the tubes.

18. A snorkel according to claim 1, including coupling means comprising an elastic tab provided with a hole and connected to a surface of one of the tubes and a tooth connected to the surface of the other tube and positioned to receive the hole in the elastic tab.

19. A snorkel according to claim 18, wherein said tooth and said elastic tab are formed as one piece on their respective tubes.

20. A snorkel according to claim 1, wherein the upper tube is curved in said lying plane with the same curvature as the lower tube, such that in the non-use position, the two curved tubes are side-by-side throughout their lengths.

* * * * *